US006198234B1

(12) United States Patent
Henry

(10) Patent No.: US 6,198,234 B1
(45) Date of Patent: Mar. 6, 2001

(54) DIMMABLE BACKLIGHT SYSTEM

(75) Inventor: George C. Henry, Camarillo, CA (US)

(73) Assignee: Linfinity Microelectronics, Garden Grove, CA (US)

( * ) Notice: Subject to any disclaimer, the term of this patent is extended or adjusted under 35 U.S.C. 154(b) by 0 days.

(21) Appl. No.: 09/328,536

(22) Filed: Jun. 9, 1999

(51) Int. Cl.[7] ..... G05F 1/00
(52) U.S. Cl. ..... 315/291; 315/307
(58) Field of Search ..... 315/219, 209 PZ, 315/307, 86, 291, 224, DIG. 4, DIG. 5, 209 R; 345/102; 399/51

(56) References Cited

U.S. PATENT DOCUMENTS

| | | | | |
|---|---|---|---|---|
| 4,053,813 | | 10/1977 | Kornrumpf et al. . | |
| 4,307,441 | | 12/1981 | Bello . | |
| 4,453,522 | | 6/1984 | Salzgeber . | |
| 4,480,201 | | 10/1984 | Jaeschke . | |
| 4,555,673 | | 11/1985 | Huijsing et al. . | |
| 4,585,974 | | 4/1986 | Stupp et al. . | |
| 4,626,770 | | 12/1986 | Price, Jr. . | |
| 4,682,080 | | 7/1987 | Ogawa et al. . | |
| 4,779,037 | | 10/1988 | LoCascio . | |
| 4,792,747 | | 12/1988 | Schroeder . | |
| 4,812,781 | | 3/1989 | Regnier . | |
| 4,885,486 | | 12/1989 | Shekhawat et al. . | |
| 5,083,065 | | 1/1992 | Sakata et al. . | |
| 5,130,635 | | 7/1992 | Kase . | |
| 5,220,272 | | 6/1993 | Nelson . | |
| 5,235,254 | * | 8/1993 | Ho | 315/219 |
| 5,289,051 | | 2/1994 | Zitta . | |
| 5,327,028 | | 7/1994 | Yum et al. . | |
| 5,471,130 | | 11/1995 | Agiman . | |
| 5,475,285 | | 12/1995 | Konopka . | |
| 5,479,337 | | 12/1995 | Voigt . | |
| 5,514,947 | | 5/1996 | Berg . | |
| 5,528,192 | | 6/1996 | Agiman . | |
| 5,552,697 | | 9/1996 | Chan . | |
| 5,563,501 | | 10/1996 | Chan . | |
| 5,608,312 | | 3/1997 | Wallace . | |
| 5,612,594 | | 3/1997 | Maheshwari . | |
| 5,615,093 | | 3/1997 | Nalbant . | |
| 5,619,402 | | 4/1997 | Liu . | |
| 5,719,474 | * | 2/1998 | Vitello | 315/307 |
| 5,748,460 | | 5/1998 | Ishikawa . | |
| 5,818,172 | * | 10/1998 | Lee | 315/86 |
| 5,854,617 | * | 12/1998 | Lee et al. | 345/102 |
| 5,886,477 | * | 3/1999 | Honbo et al. | 315/209 PZ |
| 5,907,742 | * | 5/1999 | Johnson et al. | 399/51 |

* cited by examiner

*Primary Examiner*—Don Wong
*Assistant Examiner*—Chuc D Tran
(74) *Attorney, Agent, or Firm*—Knobbe, Martens, Olson & Bear, LLP

(57) ABSTRACT

A dimmable, backlight system provides increased light output at low temperatures and provides a full range of dimming. Both current amplitude control and current duty cycle control are used to more precisely adjust the lamp light output. During low temperatures, the lamp is overdriven using a high amplitude current source. The increased current provides increased light output at low temperatures. When the lamp temperature increases, the amount of current flowing to the lamp is reduced to prevent damage from occurring to the lamp. The lamp may be dimmed throughout the entire temperature range by adjusting the duty cycle of the current source. By dimming using the duty cycle, the light output of the lamp may be more precisely controlled. The amplitude and duty cycle may be controlled using either an analog or digital control signal.

53 Claims, 7 Drawing Sheets

DIMMABLE BACKLIGHT SYSTEM

BACKGROUND OF THE INVENTION

1. Field of the Invention

This present invention relates to a power conversion circuit for driving fluorescent lamps, such as, for example, cold cathode fluorescent lamps (CCFLs) and more particularly to the drive topology of such circuits.

2. Description of the Related Art

Fluorescent lamps are used in a number of applications where light is required but the power required to generate light is limited. One such application is the backlighting for a flat panel computer display, or the like. One particular type of fluorescent lamp is a cold cathode fluorescent lamp (CCFL). CCFL tubes typically contain a gas, such as Argon, Xenon, or the like, along with a small amount of Mercury. After an initial ignition stage and the formation of plasma, current flows through the tube, which results in the generation of ultraviolet light. The ultraviolet light in turn strikes a phosphorescent material coated in the inner wall of the tube, resulting in visible light.

One problem with CCFL tubes is that such tubes do not generate a high level of light output at low temperatures. When these systems are installed where they are exposed to environmental conditions, such as in automobiles, it can take several minutes of operation before the lamp temperature reaches a point to generate an acceptable amount of light output. This makes the backlight systems unusable at low temperatures.

To combat this problem, some manufactures developed "self-heating" lamps. Essentially, these lamps contain two different gases, one optimized to operate at a cold temperature and a second optimized at a normal operating temperature. At low temperatures, the first gas glows and provides an enhanced light output. After the lamp warms up, the second gas takes over and provides the light output. Although these self-heating lamps provide some improvement, the light output at low temperatures is still below the desired range.

Further, it is often desired to control the brightness of the backlight systems Even at low lamp temperatures, it may desirable to have a controllable level of brightness. Dimming of conventional backlight systems is accomplished by adjusting the amplitude of the current. However, the precision of dimming available with amplitude control is limited. Using amplitude controlled dimming, most CCFL tubes are limited to a 3:1 dimming range. Further, decreasing the current amplitude at low temperature may not be feasible.

Because CCFL lamps are installed in a variety of locations, the type of input signal received by a backlight system may vary. The input signals, which may control a variety of functions of the lamp, including but not limited to power on and off, brightness control, contrast control, or the like, may be a digital control signal or a DC voltage. Previously, separate input circuits were necessary depending on the type of input signal to be used.

A power conversion circuit is needed which permits an increased brightness level at low temperatures. Further, the power conversion circuit should be capable of accepting either digital or analog inputs.

SUMMARY OF THE INVENTION

The present invention provides increased light output at low temperatures and also provides a full range of dimming. Both current amplitude control and current duty cycle control are used to more precisely adjust the lamp light output. During low temperatures, the lamp is overdriven using a high amplitude current source. The increased current provides increased light output at low temperatures. When the lamp temperature increases, the amount of current flowing to the lamp is reduced to prevent damage to the lamp. The lamp may be dimmed throughout the entire temperature range by adjusting the duty cycle of the current source. By dimming using the duty cycle, the light output of the lamp may be more precisely controlled. The amplitude and duty cycle may be controlled using either an analog control signal or a digital control signal.

One embodiment of the present invention is a dimmable backlight system. The backlight system comprises a lamp and at least one integrator for converting a control signal into a DC voltage. A controller receives the DC voltage and adjusts either the duty cycle or the amplitude of an output signal based on the DC voltage. A network converts the output signal into a substantially sinusoidal AC current to illuminate the lamp at a plurality of different brightness levels.

Another aspect of the present invention is a method of illuminating a backlight lamp. The method comprises the steps of supplying a current signal to the lamp at a first current level and detecting the temperature of the lamp. It is then determined whether the temperature exceeds a predetermined level. The current level of the current signal is reduced when the signal exceeds the predetermined level.

Another aspect of the present invention is a method of dimming a backlight lamp. The method comprises the steps of receiving a first control signal indicating the desired current duty cycle and receiving a second control signal indicating the desired current amplitude. An AC current having a defined amplitude and duty cycle is then generated.

Another aspect of the present invention is a backlight system. The system comprises a lamp and a current source which provides a drive current to the lamp. A temperature detector determines the temperature of the lamp. A controller then adjusts the amplitude of the current source based on the temperature of the lamp.

Another aspect of the present invention is an integrator for converting an input signal of either a digital pulse train or an analog waveform into a DC voltage. The integrator comprises a first voltage amplifier which receives the input signal and clamps the input signal at a predetermined level. The first voltage amplifier amplifies the input signal to generate an output signal. A second amplifier receives and integrates the output signal to create a DC voltage.

BRIEF DESCRIPTION OF THE DRAWINGS

These and other features and advantages of the invention will become more apparent upon reading the following detailed description and upon reference to the accompanying drawings, in which;

FIG. 6, comprising

DETAILED DESCRIPTION OF THE PREFERRED EMBODIMENTS

Figure 1:
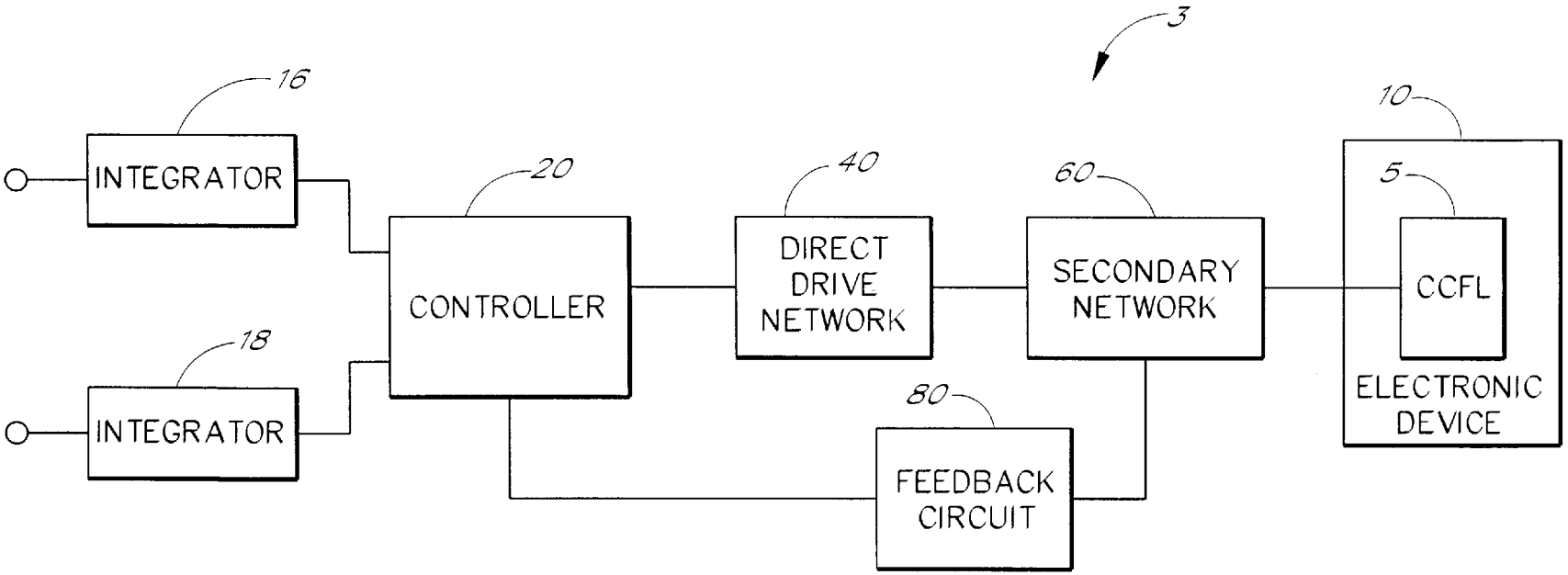
FIG. 1 is a block diagram of a power conversion circuit according to one embodiment of the present invention.

As illustrated in FIG. 1, a power conversion circuit 3 in accordance with a first embodiment of the present invention comprises integrators 16, 18, a controller 20, a direct drive network 40, a secondary network 60, a CCFL 5 and a feedback circuit 80. The CCFL 5 provides illumination in an electronic device 10, such as, for example, a flat panel display, a computer, a personal digital assistant, a palm top computer, a scanner, a facsimile machine, a copier, or the like.

The integrators 16, 18 receives control signals in the form of either a digital pulse train or a DC waveform. The integrators convert the control signals into input signals comprising a DC voltage. The controller 20 receives the DC voltage input signals from the integrators 16, 18.

The controller 20 is coupled to the direct drive network 40 which comprises a plurality of switching transistors coupled between the supply voltage VDD (e.g., 12V) and the ground in a full bridge topology. The control node (e.g., gate) of each transistor is coupled to the controller 20 to allow the controller 20 to control the switching of each transistor. The direct drive network 40 also comprises a primary winding of a transformer which also has a secondary winding. The primary winding of the transformer generally operates as an inductive circuit with some parasitic capacitance. The outputs of the transistors are coupled directly to the primary winding without using any inductors and capacitors to tune the primary circuit to the operating frequency of the controller 20.

The primary winding of the direct drive network 40 is magnetically coupled through a permeable core to a secondary network 60. The secondary network 60 comprises the secondary winding of the transformer, a reactive circuit element and a connector coupled to the CCFL 5. The direct drive and secondary networks convert the DC voltage coupled through the transistors into a substantially sinusoidal AC current. The sinusoidal AC current passes through the CCFL 5 to illuminate the CCFL 5. As set forth above, the impedance of the direct drive network 40 is largely inductive from the primary winding of the transformer with the capacitive reactance arising principally from the parasitic capacitances reflected from the secondary winding.

The secondary network 60 is coupled to a feedback circuit 80 which is also coupled to the controller 20 in order to provide a feedback signal to the controller 20. The feedback circuit 80 detects the total current passing through the CCFL 5 and generates a voltage signal representative of the total current. The feedback circuit 80 may also be connected to a temperature sensor on the CCFL 5. The temperature sensor detects the temperature of the CCFL 5 and generates a signal representative of the temperature of the CCFL 5. In the preferred embodiment, the temperature sensor (not shown) is a thermistor mounted on the glass surface of the lamp. The feedback circuit 80 provides the feedback voltage signal to the controller 20 so that the controller 20 can appropriately adjust the current passing through the CCFL 5.

Figure 2:
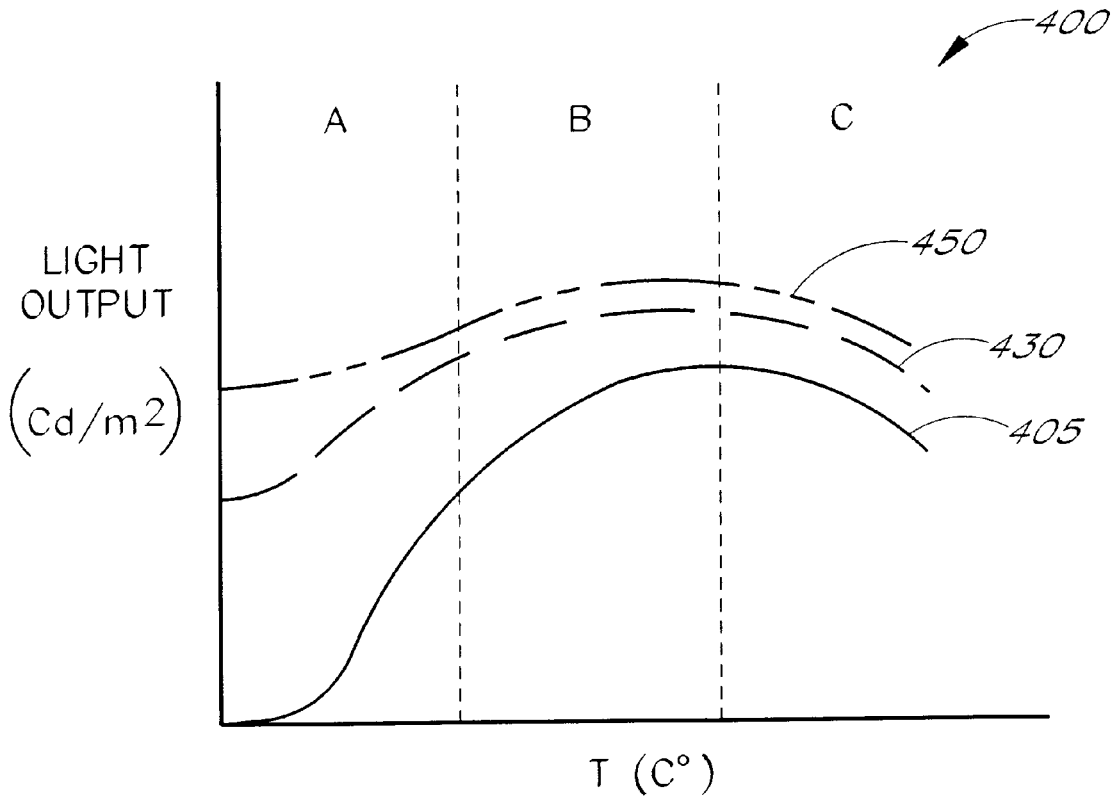
FIG. 2 illustrates the light output of power conversion circuits as a function of both current and temperature.

The light output of the CCFL 5 varies as a function of both temperature and input current. FIG. 2 illustrates the light output of typical lamps used in a backlight display environment. FIG. 2 illustrates a graph 400 of the light output measured in candellas/meter$^2$ of various CCFL lamps as a function of temperature. The light output of the lamp can be viewed in three separate stages. At low temperatures, shown as Section A of the graph 400, the light output of the lamp is generally low for a given current input. Section A of the graph 400 illustrates the light output of the lamp in cold temperatures before warm-up, and the temperature generally ranges from about −40° C. to about 0° C. After the lamp warms up, the light output increases for a given level of current input as shown in Section B of the graph 400. Section B of the graph 400 illustrates the optimum temperature operating range for the lamp, with the lamp temperature generally ranging from about 50° C. to about 60° C. Eventually, the lamp reaches a temperature where the light output begins to decrease again, and this is illustrated in Section C of the graph 400. The light output begins to decrease beginning at lamp temperatures above 70° C.

The light output of a first lamp having a standard drive current of approximately 6 milliamperes (mA) is shown as line 405 of the graph 400. In cold temperatures as illustrated by Section A, the amount of light generated by the 6 mA of current flowing to the lamp is very low. This amount of light output is generally insufficient to provide adequate backlighting for a flat panel display. After a period of time the 6 mA of current flowing through the lamp heats up the lamp. After the lamp is heated, the amount of light output by the lamp is illustrated by the portion of the line 405 in Section B. The light output in this section is within the recommended amount of light output for backlighted devices. If the lamp gets too warm, the light output actually decreases for the same 6 mA of current, as illustrated by the portion of the line 405 in Section C.

The light output of a second lamp having a drive current of approximately 12 mA is shown as line 430. A lamp is overdriven when the lamp has a current above the normal operating range. In one embodiment, the lamp is overdriven when the current is in the range of above approximately 7 mA, and more preferably at approximately 12 mA. At low temperatures, it is safe to overdrive the lamp without damaging the lamp. However, after the lamp warms up, overdriving the lamp with current may damage the lamp. With the overdrive current flowing, the low temperature portion of the line 430 as illustrated by Section A generates an increased amount of light as compared with the 6 mA lamp of the line 405. This increased light output is generally sufficient to provide adequate backlighting for a flat panel display. After the lamp heats up, the amount of light generated by the lamp is illustrated by the portion of the line 430 in Section B. The light output during these conditions is also increased as compared with the non-overdriven lamp shown in line 405, but is also within the recommended amount of light output for backlighted devices. However, overdriving the lamp in this temperature range shortens the amount of time it takes the lamp to further heat and begin operating in the temperature range illustrated by portion of the line 430 in Section C. Further, overdriving the lamp at a warm temperature may damage the lamp and shorten the overall life of the lamp. After the lamp temperature increases, the performance of the lamp is indicated by the portion of the line 430 in Section C. During this condition, the light output actually decreases for the same 12 mA of current.

The light output of a third, self-heating lamp having a drive current of approximately 12 mA is shown as line 450. The self-heating lamp contains two distinct gases, one optimized to operate at low temperatures and a second optimized to operate at normal to high temperatures. With the overdrive current flowing through the self-heating lamp during low temperatures, the amount of lamp light output is increased as compared to the standard 12 mA lamp shown in the line 430. In the portion of the line 450 in Section A, the low temperature gas is illuminating the lamp. After the lamp heats up, the amount of light output by the lamp is illustrated by the portion of the line 450 in Section B. During this portion of the line 450, the lamp is illuminated by the higher temperature gas and the low temperature gas. As with the normal overdriven lamp shown on line 430, the light output in this section is also increased as compared with the non-overdriven lamp shown in line 405, but is also within the recommended amount of light output for backlight devices. However, overdriving the self-heating lamp at this point also shortens the amount of time it takes the lamp to further heat to the point that it is operating in the range illustrated by the portion of the line 450 in Section C, and overdriving may shorten the overall life of the lamp. After the lamp gets too warm, the performance of the lamp is indicated by the portion of the line 450 in Section C. During this condition, the light output decreases for the same 12 mA of current.

In an optimum environment in accordance with the present invention, a lamp is overdriven at low temperature to provide an increased amount of light at start up. After the lamp warms up, the amount of current is reduced to maintain a high level of light output while preventing damage to the lamp. The present invention provides precise control of the lamp current as either a function of temperature or time. The steps for achieving this control are illustrated in FIGS. 3A and 3B.

Figure 3A:
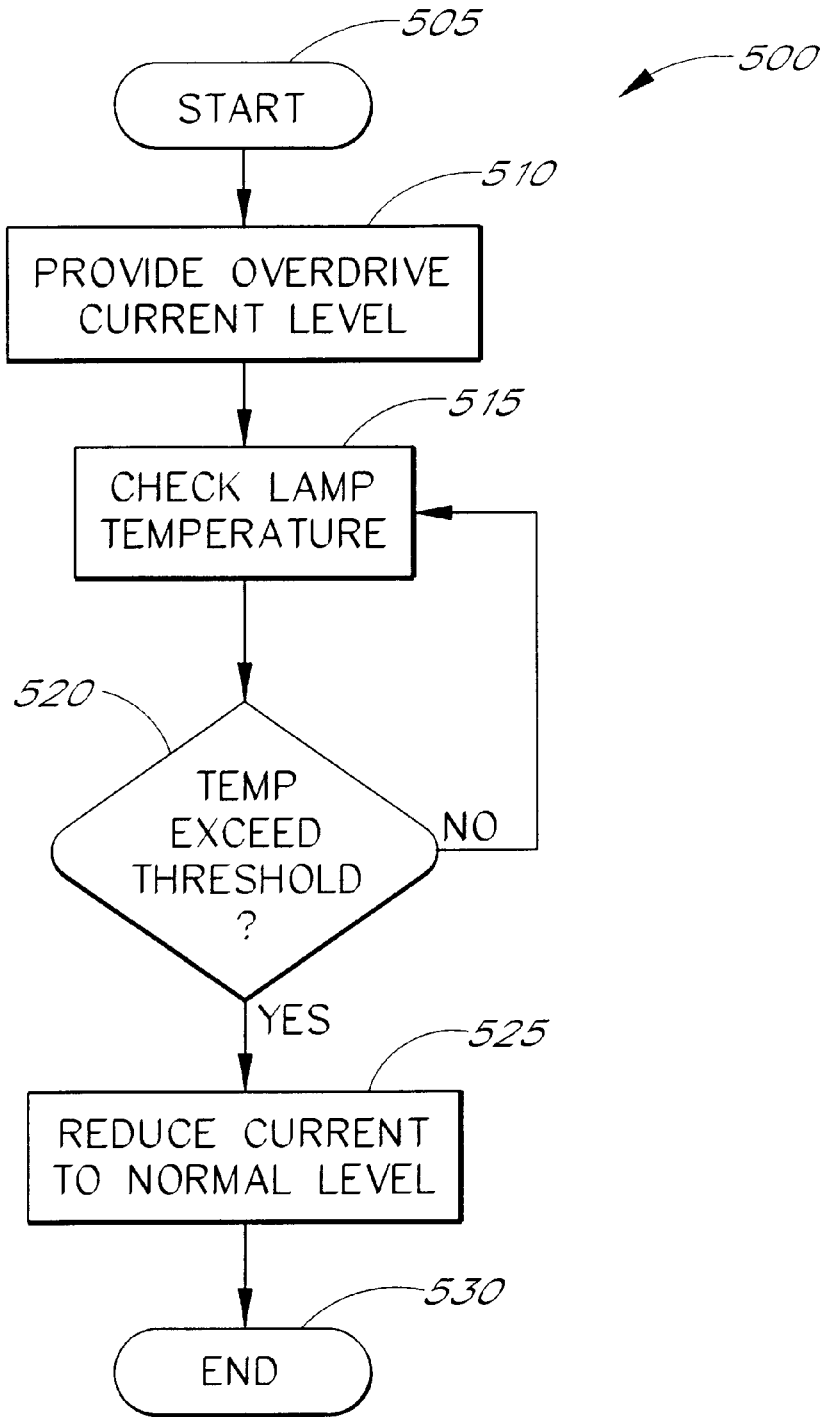
FIG. 3A illustrates the process for overdriving the lamp current based on lamp temperature.
Figure 3B:
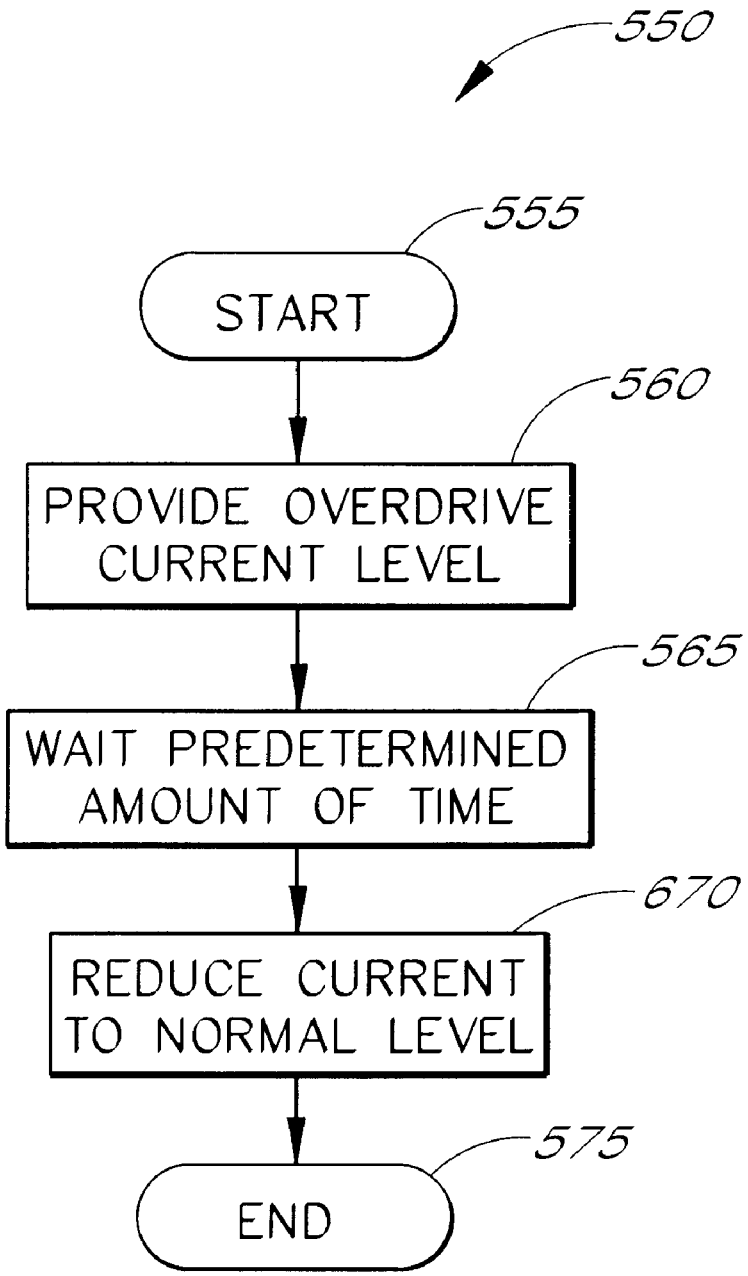
FIG. 3B illustrates the process for overdriving the lamp current based on elapsed time.

FIG. 3A illustrates a process 500 used to control the amount of lamp current as a function of temperature. The process begins at a start state 505. Proceeding to an active state 510, the controller 20 instructs the direct drive network 40 and the secondary network 60 to provide the lamp 5 with an overdrive current level of approximately 12 mA. As stated above, at low temperatures, the overdrive current provides an increased light output without damaging the lamp.

Proceeding to a state 515, the temperature of the lamp is detected. This may be accomplished by installing a resistance temperature device (RTD) or other temperature detector to the lamp. This information is advantageously provided to the controller 20 as part of the feedback circuit 80. The RTD may be installed directly on the lamp or proximate the lamp.

Proceeding to a decision state 520, the controller 20 determines whether the temperature has exceeded a predetermined threshold. This threshold may typically be set based upon the lamp operating characteristics to be a temperature at a transition between Section A and Section B in FIG. 2. This ensures the overdrive current is provided during the entire low temperature range. If the temperature has not exceeded the threshold, the process 500 proceeds along the NO branch back to the state 515 to redetect the lamp temperature. The process 500 remains in this loop until the threshold lamp temperature is reached.

When the controller is in the decision state 520, once the temperature is determined to have exceeded the predetermined threshold, the process proceeds along the YES branch to a state 525. In the state 525, the current level is reduced to a normal operating level of approximately 6 ma. This reduces the risk of damaging the lamp by overdriving a warm lamp. However, because the lamp is warm, the reduced level of current flow still provides adequate light output. The process 500 then terminates in an end state 530.

In addition to reducing the current flow once a temperature threshold is reached, the controller 20 may also create a table to adjust the current flow as a function of temperature. For example, the current may be slowly decreased as the lamp warms according to the following table:

| Temperature (° C.) | Current (mA) |
|---|---|
| −40 | 10 |
| −25 | 9 |
| −15 | 8 |
| 0 | 7 |
| 25andhigher | 6 |

FIG. 3B illustrates an alternate embodiment of the invention where the amount of lamp current is controlled as a function of time. In this embodiment, the performance characteristics of a particular lamp have been predetermined. Based upon these characteristics, it can be determined the appropriate amount of time it takes the lamp to warm. Instead of detecting the lamp temperature, the controller overdrives the lamp current for this time interval.

In FIG. 3B, a process 550 based upon time begins at a start state 555. Proceeding to a decision state 560, the controller 20 instructs the power conversion circuit to provide the lamp 5 with an overdrive current level of approximately 12 mA. As stated above, at low temperatures, the overdrive current provides an increased light output without damaging the lamp 5.

Proceeding to a wait state 565, the controller 20 waits a predetermined time interval. The time interval may be preselected based upon the warming characteristics of the lamp. The time required for any particular lamp to warm up may be pre-programmed into the controller 20. By using this data, the circuit does not need a RTD or any temperature indications in the feedback circuit 80.

After the predetermined time interval has expired, the process 550 proceeds to an active state 570. In the active state 570, the current level is reduced to a normal operating level of approximately 6 mA. This reduces the risk of damaging the lamp by overdriving a warm lamp. However, because the lamp is warm, the reduced level of current flow still provides adequate light output. The process 550 then terminates in an end state 575.

In addition to overdriving the lamp to provide increased light output at low temperatures, the present invention permits dimming of the CCFL 5 using either amplitude current control, duty cycle current control, or a combination of amplitude and duty cycle current control. Conventionally, lamps are dimmed using only amplitude control. However, amplitude control limits the range of dimming to only a factor of 3. By using duty cycle control, the full amplitude of the current is maintained so the lamp remains lit. By adjusting the duty cycle of the current, the range of dimming can be increased to a factor of 100.

Figure 4:
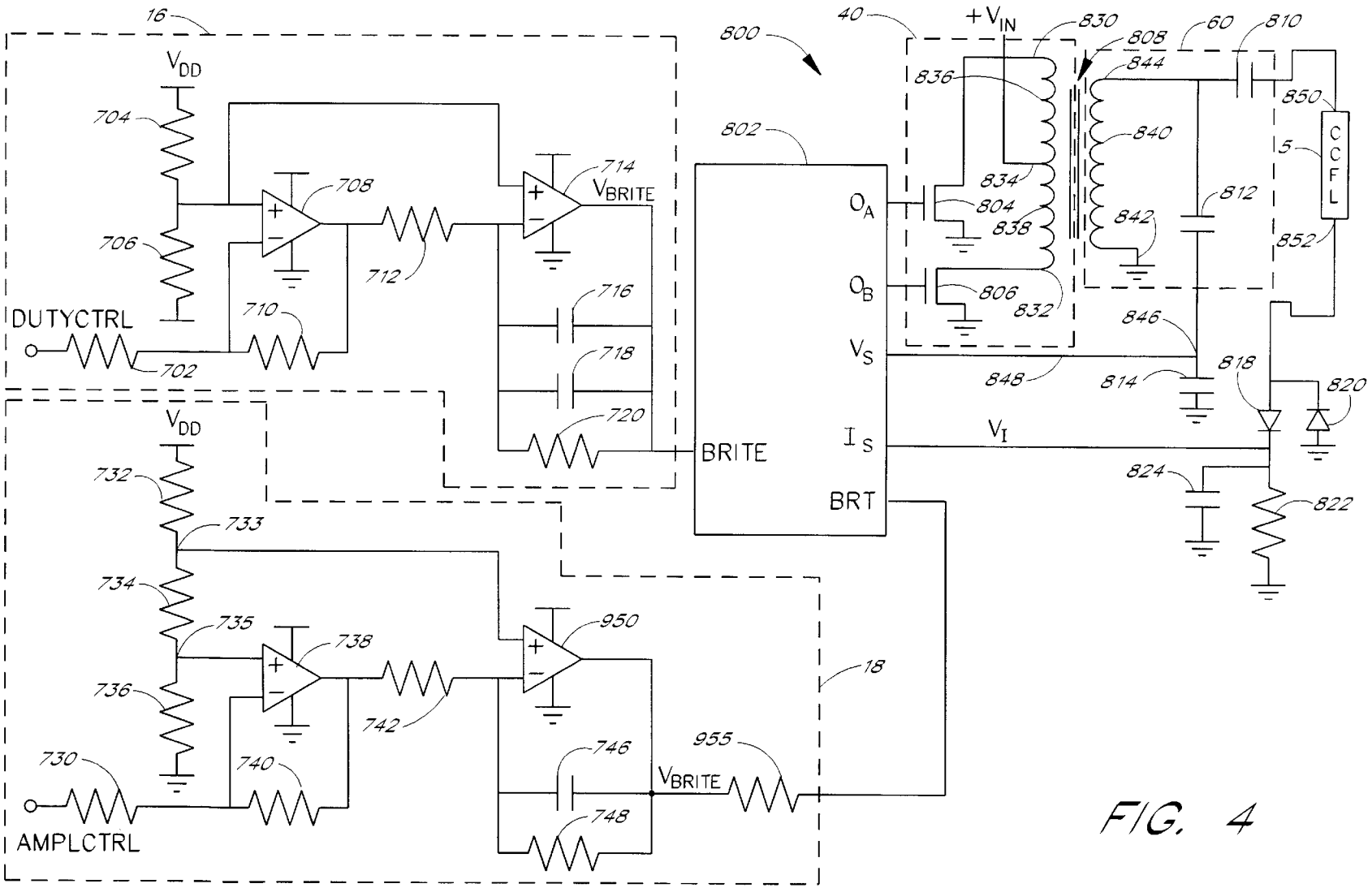
FIG. 4 is a schematic diagram of the power conversion circuit according to an embodiment of the present invention.

FIG. 4 illustrates an embodiment of the present invention in which two transistors drive the primary winding of the transformer.

FIG. 4 illustrates a drive circuit 800 which comprises a pulse width modulation (PWM) circuit 802, a fist switching transistor 804, a second switching transistor 806, a transformer 808, a DC blocking capacitor 810, a first voltage divider capacitor 812, a second voltage divider capacitor 814, a first diode 818, a second diode 820, a current sensing resistor 822 and a current sensing filter capacitor 824. The cold cathode fluorescent lamp (CCFL) 5 is connected to the drive circuit. In the preferred embodiment, the PWM controller 802 is an LX1686 regulating pulse width modulator, available from Linfinity Microelectronics Inc. of Garden Grove, Calif., or an equivalent thereof available from a number of industry sources.

As illustrated, the first switching transistor 804 is an N-channel field-effect transistor (FET) which has a gate connected to a first output ($O_A$) of the PWM circuit 802, which has a drain connected to ground and which has a source connected to a first terminal 830 of the primary of the transformer 808. The second switching transistor 806 is also an N-channel FET which has a gate connected to a second output ($O_B$) of the PWM circuit 802, which has a drain connected to ground and which has a source connected to a second terminal 832 of the primary of the transformer 808. The primary of the transformer 808 has a centertap 834 to provide an upper winding primary 836 between the terminal 830 and the centertap 834 and to provide a lower primary winding 838 between the terminal 832 and the centertap 834. The centertap 834 is connected to a source ($+V_{IN}$) of DC power, which may vary from approximately 8 volts to approximately 21 volts.

Figures 6A, 6B:
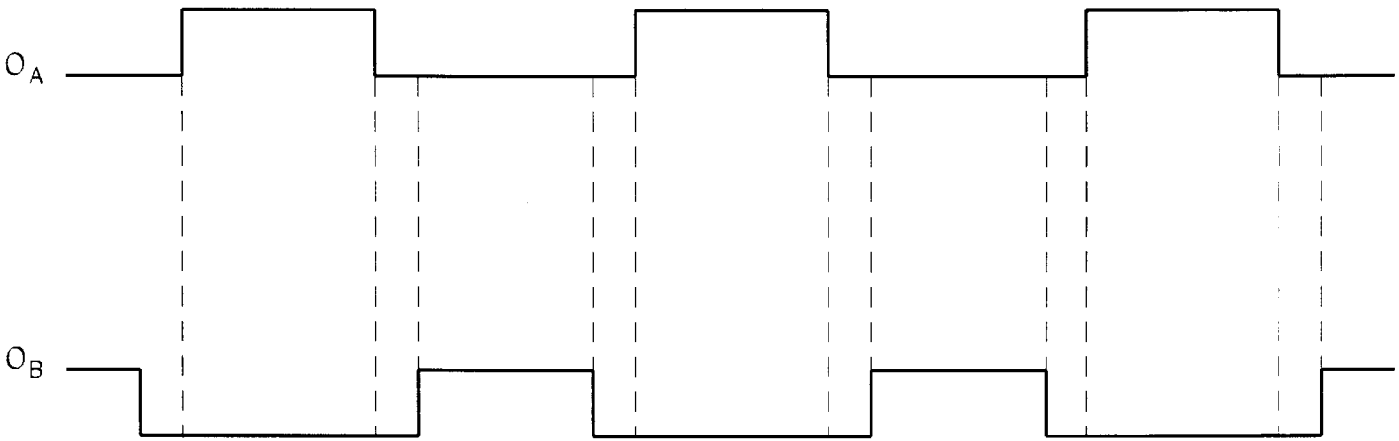
FIGS. 6A–6B, illustrates the voltage waveforms of the switching transistor drive signals generated by the PWM circuit of FIG. 4.

In operation, a high voltage signal on the gate of the transistor 804 or on the gate of the transistor 806 will turn on the respective transistor and provide a conductive path from the respective terminal of the primary winding, through the transistor to ground. Specifically, when the output $O_A$ is high, the transistor 804 conducts, and a current flows from the voltage source $+V_{IN}$ through the centertap 834 and the upper winding 836 to the terminal 830. When the output $O_B$ is high, the transistor 806 conducts, and a current flows from the voltage source $+V_{IN}$ through the centertap 834 and the lower winding 838 to the terminal 832. Thus, by alternately switching the transistors 804 and 806 on, as illustrated by the signal waveform $O_A$ in FIG. 6A and the signal waveform $O_B$ in FIG. 6B, a current is caused to flow in the primary windings 836, 838, first in one direction from the centertap 834 through the upper winding 836, and then in the opposite direction from the centertap 834 through the lower winding 838. As further illustrated in FIGS. 6A and 6B, the signals $O_A$ and $O_B$ are timed such that both signals are never active high at the same time. In preferred embodiments, the transistors 804, 806 are turned on and off at a very high frequency. For example, in one particularly preferred embodiment, the transistors are turned on and off at a frequency of approximately 60 kHz.

The transformer 808 has a secondary winding 840 which has a first terminal 842 connected to ground and a second terminal 844 connected to a first terminal of the DC blocking capacitor 810 and to a first terminal of the first voltage divider capacitor 812. A second terminal of the first voltage divider capacitor 812 is connected to a node 846. A first terminal of the second voltage divider capacitor 814 is also connected to the node 846. A second terminal of the second voltage divider capacitor 814 is connected to ground. As will be discussed below, a sense voltage is developed on the node 846. The node 846 is connected via a line 848 to a voltage sense input ($V_S$) input of the PWM circuit 802. In the preferred embodiment, the first voltage divider capacitor 812 has a capacitance of approximately 1.3 picofarads, and the second voltage divider capacitor 814 has a capacitance of approximately 470 picofarads. Thus, the sense voltage on the node 846 will have a voltage which is approximately 0.3 percent of the voltage across the secondary winding 840.

The DC blocking capacitor 810 couples the current generated in the secondary winding 840 to a first terminal 850 of the CCFL 5. A second terminal 852 of the CCFL 5 is coupled to the anode of the first diode 818 and to the cathode of the second diode 820. The anode of the second diode 820 is connected to ground. The anode of the first diode 818 is connected to a first terminal of the current sensing resistor 822. A second terminal of the current sensing resistor 822 is connected to ground. In one particular embodiment, the current sensing resistor 822 has a value of approximately 953 ohms.

The first diode 818 operates as a half-wave rectifier such that a current sense voltage $V_I$ develops across the resistor 822 and the filter capacitor 824 responsive to the current through the CCFL 5 that flows from the terminal 844 of the secondary winding, through the DC blocking capacitor 810, through the CCFL 5, through the diode 818 and the resistor 822 to ground, and then to the terminal 842. The current sense voltage $V_I$ is provided as an input to a current sense input ($I_S$) of the PWM circuit 802.

The second diode 820 provides a current path for the alternate half-cycles when the current flows out of the terminal 842 to ground, through the second diode 820, through the CCFL 5, through the DC blocking capacitor 810 and to the terminal 844.

In the embodiment of FIG. 4, the PWM circuit 802 monitors the current via the current sense input $I_S$ and varies the pulse width modulation applied to the first and second switching transistors 804, 806. That is, if the sensed current is less than a desired current, then the transistors 804, 806 are turned on for a greater duration in each cycle to increase the total current provided to the lamp 5. Conversely, if the sensed current is greater than a desired current, then the transistors 804, 806 are turned on for a shorter duration in each cycle to decrease the RMS current provided to the lamp 5. Although the duty cycles of the transistors 804, 806 are varied, the switching frequency remains generally constant at approximately 60 kHz or at another selected high frequency. (Note, as discussed below, the transistors 804, 806 may be turned completely off for time intervals not related to the switching frequency; however, when the transistors 804, 806 are switching, the switching frequency remains generally constant.)

The first and second voltage divider capacitors 812, 814 provide an overvoltage protection circuit for the drive circuit 800. The voltage applied to the $V_S$ input of the PWM circuit 802 operates as a shutdown voltage to prevent the voltage across the secondary 840 of the transformer 808 from becoming to great. In particular, the voltage applied to the $V_S$ input may exceed a particular amount which is greater than approximately the voltage across two internal series connected diodes within the PWM circuit 802. When that voltage is exceeded, an internal signal is applied to the pulse width modulator within the PWM circuit to reduce the durations of the active signals generated at the outputs $O_A$ and $O_B$, thus reducing the duration of the input currents applied to the primary windings 836, 838 of the transformer 808. Thus, for example, if the voltage across the secondary winding 840 of the transformer 808 increases as the impedance of the CCFL 5 increases with age or if the CCFL 5 is disconnected or broken, the voltage provided by the voltage divider capacitors 812, 814 limits the maximum voltage generated across the secondary winding 840. The voltage from the voltage divider capacitors 812, 814 is applied to the $V_S$ input through a buffering circuit (not shown).

As discussed above, the PWM circuit 802 monitors the current flowing through the lamp 5, compares the monitored current to a desired current, and varies the duty cycles of the two switching transistors 804, 806 to maintain the monitored current approximately equal to the desired current. The brightness of the lamp 5 may be varied by varying the desired current to which the monitored current is compared. The PWM circuit 802 includes two inputs which control the desired current and thereby control the current provided to the lamp 5. In particular, the PWM circuit 802 includes a BRITE input and a BRT input. The BRITE input and the BRT input are each responsive to a respective analog input voltage. As will be discussed below in connection with FIG. 5, the BRITE input varies a low frequency duty cycle (or burst cycle) of the desired current, and the BRT input varies the amplitude of the desired current. Thus, the two inputs operate together to control the lamp current.

As discussed above, the transistors 804, 806 are switched on and off at a frequency of approximately 60 kHz. In addition, the duty cycles of the transistors 804, 806 are varied to control the current in response to a comparison with a desired current. Thus, if the desired current is increased, the duration of the time that each transistor is on is increased; and if the desired current is decreased, the duration of the time that each transistor is on is decreased. The brightness of the lamp 5 will vary accordingly; however, there is a limit to the amount of brightness control that can be obtained by varying current amplitude alone. The brightness of the lamp can also be adjusted by imposing a low frequency duty cycle on the desired current. In other words, the desired current can be controlled to a zero value (or some other low value) so that the transistors 804, 806 are not turned on for any portion of high frequency cycles. This low frequency duty cycle control is generally performed at a frequency of 90–300 Hz so that any flicker of the lamp 5 caused by turning the lamp on and off is not perceptible by the human eye.

Figure 5:
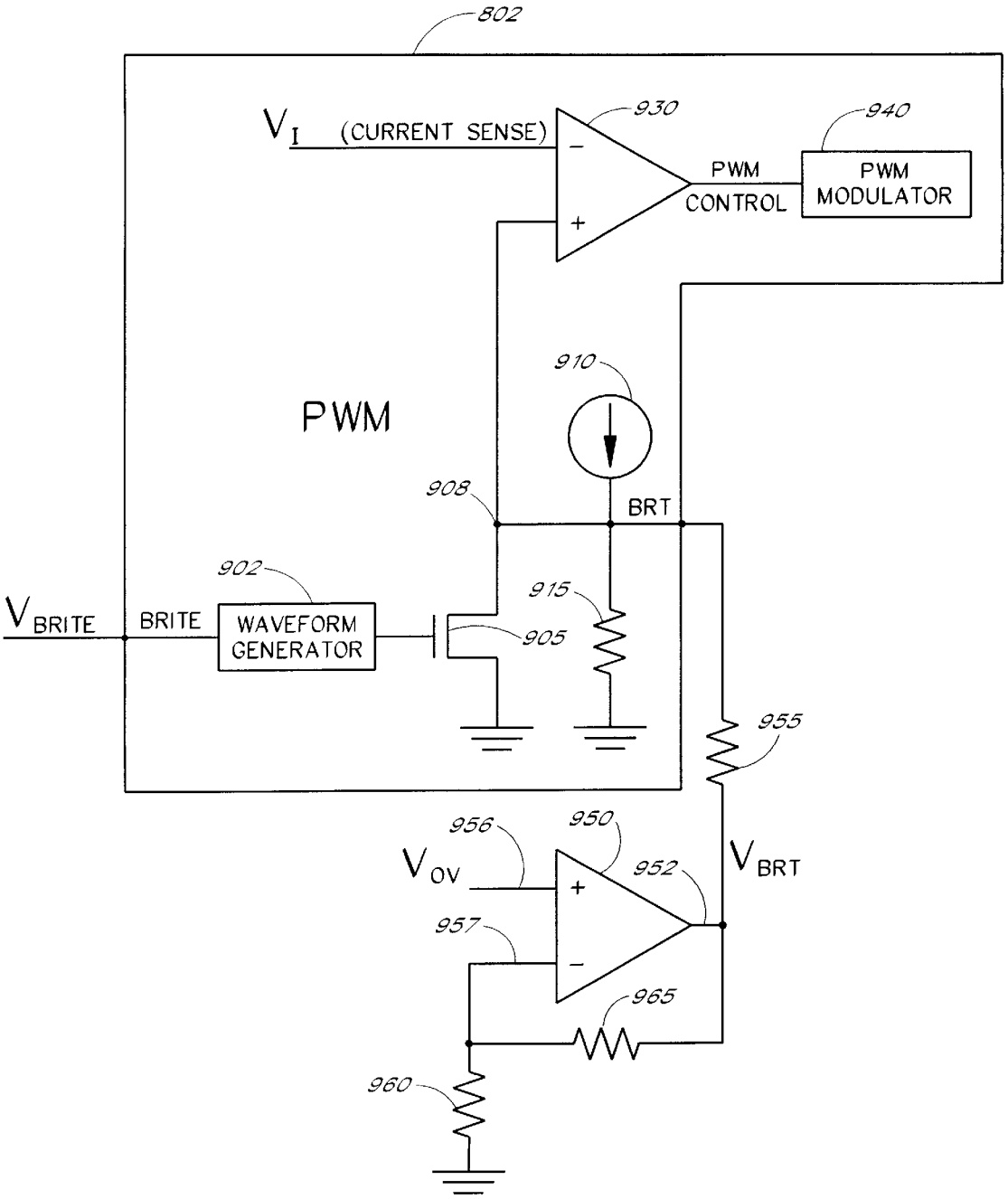
FIG. 5 is a schematic diagram of a portion of the power conversion circuit illustrating the amplitude and duty cycle control of the output signals of the PWM circuit.

FIG. 5 illustrates a portion of the internal circuitry of the pulse width modulation (PWM) circuit 802 which shows the interrelationship between the amplitude control and the duty cycle control of the lamp current. The illustrated portion implements the brightness control using a combination of low frequency duty cycle control in response to the signal applied to the BRITE input and amplitude control in response to a signal applied to the BRT input. A DC voltage $V_{BRITE}$, received from the integrator 16 (FIGS. 1 and 4), is provided to the BRITE input of the PWM circuit 802. The value of $V_{BRITE}$ controls the low frequency duty cycle of the output current. The $V_{BRITE}$ voltage is provided as the control input to a waveform generator 902 which is included within the PWM circuit 802. The waveform generator 902 is responsive to the DC voltage at the BRITE input to generate an output signal having an appropriate duty cycle. In one particular embodiment of the present invention, a value of $V_{BRITE}$ of approximately 0 volts provides an output signal having a 0% duty cycle and a value of $V_{BRITE}$ of approximately 2.5 volts provides an output signal with a 100% duty cycle. The duty cycle may be varied between 0% and 100% by varying the value of $V_{BRITE}$ between 0 volts and 2.5 volts. The output signal from the waveform generator 902 has a frequency of, for example, 90 Hz to 300 Hz.

The output signal from the waveform generator 902 is provided as the control input to a gate of a switching transistor 905. In the illustrated embodiment, the transistor 905 is an N-channel FET which has a drain connected to a node 908. The node 908 is also connected to the output of a current source 910, to the BRT input of the PWM circuit 602 and to a first terminal of a resistor 915. A source of the transistor 905 is connected to circuit ground. A second terminal of the resistor 915 is also connected to ground.

The current source 910 provides a substantially constant current to the node 908. When the transistor 905 is not conducting, the current from the current source 910 flows through the resistor 915 and generates a voltage across the resistor 915 with respect to circuit ground. The voltage across the resistor 915 is thus the voltage on the node 908. The node voltage is provided as one input to a differential amplifier 930. A second input to the differential amplifier 930 is the current sense voltage $V_I$. The differential amplifier 930 compares the current sense voltage to the node voltage and provides an output voltage (PWM CONTROL) which varies in accordance with the difference between the two voltages. The output voltage from the differential amplifier is provided as the control input to the internal high frequency pulse (PWM) modulator 940 to control the duty cycle of the 60 kHz signal generated by the PWM modulator 940 so that the difference between the two voltages is minimized. Thus, the amplitude of the node voltage determines the duty cycles of the two switching transistors 804, 806.

When the transistor 905 conducts, the current from the current source 910 is shunted to ground and bypasses the resistor 915. Thus, the voltage across the resistor 910 is substantially zero, and therefore the node voltage applied to the differential amplifier 930 is substantially zero. This causes the differential amplifier 930 to output a PWM CONTROL voltage which causes both transistors 804, 806 to have a substantially zero duty cycle during the time the transistor 905 is turned on. As discussed above, the duty cycle of the transistor 905 can be varied in accordance with the voltage $V_{BRITE}$ on the BRITE input. Thus, the switching voltage applied to the lamp 5 is modulated on and off at a low frequency in response to the voltage $V_{BRITE}$. As further discussed above, the frequency of the low frequency modulation is sufficiently high (e.g., 90–300 Hz) that the on and off modulation of the lamp 5 is perceived as a difference in brightness rather than as flickering.

As discussed above, the BRT input of the PWM circuit 802 is also connected to the node 908. The BRT input receives a voltage input $V_{BRT}$ from the integrator 18 (FIGS. 1 and 4) which determines the amplitude of the current to be generated by the PWM circuit 802. In the illustrated embodiment, the voltage input $V_{BRT}$ is provided by an output 952 of a differential amplifier 950 via a resistor 955. The differential amplifier 950 and the resistor 955 effectively operate as a variable current source. Thus, the current from the differential amplifier 950 via the resistor 955 is supplied to the node 908. When the transistor 905 is off, this current also flows through the resistor 915 and increases the voltage across the resistor 915 accordingly. As will be discussed below, the output voltage from the differential amplifier 950 is caused to vary from 1.25 volts to 2.5 volts. The resistor 955 has a value of approximately 10,000 ohms. Thus, the current provided to the node 908 via the BRT input varies from approximately 0.125 mA to approximately 0.25 mA. The effect of changing $V_{BRT}$ and thus changing the current supplied to the BRT input is to increase or decrease the node voltage when the transistor 905 is not conducting. Thus, $V_{BRT}$ determines the voltage to which the current sense voltage is compared during the active cycles of the PWM circuit 802. The voltage $V_{BRT}$ has no effect on the inactive cycles when the transistor 905 is on because the current supplied to the node 908 is shunted by the transistor 905 along with the current from the current source 910.

As discussed above, the $V_{BRITE}$ signal is generated by the integrator 16, and the BRT signal is generated by the integrator 18. The integrator 16 and the integrator 18 are shown in more detail in FIG. 4.

The integrator 16 receives a DUTYCTRL input signal and generates the $V_{BRITE}$ signal which controls the low frequency output duty cycle. As discussed below, the DUTYCTRL input signal may be a digital pulse train or an analog signal (e.g., a DC signal). The integrator 16 comprises resistors 702, 704, 706, 710, 712, and 720, capacitors 716 and 718, and differential amplifiers 708 and 714. The input signal DUTYCTRL is applied to a first terminal of the resistor 702. A second terminal of the resistor 702 is connected to an inverting input of the differential amplifier 708 and to a first terminal of the resistor 710. A first terminal of the resistor 704 is connected to a source voltage $V_{DD}$. A first terminal of the resistor 706 is connected to circuit ground. Respective second terminals of the resistors 704 and 706 are connected together to form a voltage divider between the source voltage and ground. The two second terminals are connected to a non-inverting input of the differential amplifier 708 and to a non-inverting input of the differential amplifier 714. An output of the differential amplifier 714 is connected to a second terminal of the resistor 710 and to a first terminal of the resistor 712. A second terminal of the resistor 712 is connected to an inverting input of the differential amplifier 714, to a first terminal of the capacitor 716, to a first terminal of the capacitor 718, and to a first terminal of the resistor 720. An output of the differential amplifier 714 is connected to a second terminal of the capacitor 716, to the second terminal of the capacitor 718, to a second terminal of the resistor 720. The output of the differential amplifier 714 is the $V_{BRITE}$ signal which is applied to the BRITE input of the PWM circuit 802.

The voltage divider provided by the resistors 704 and 706 applies a constant DC voltage to the non-inverting inputs of the differential amplifiers 708 and 714. For example, in the preferred embodiment, the resistor 704 has a resistance approximately three times the resistance of the resistor 706 (e.g., 18.7 Kohms versus 6.04 Kohms). Thus, when $V_{DD}$ is approximately 5 volts, the voltage applied to the non-inverting inputs of the two differential amplifiers 708, 714 is approximately 1.25 volts.

The resistors 702 and 710 configure the differential amplifier 708 as a clamped analog inverter. In one embodiment, the differential amplifier is a LM324 amplifier available from National Semiconductor or an equivalent thereof which produces output signals between ground and a high state (e.g., $V_{DD}$–1.5V). In the illustrated embodiment, the resistors 702 and 710 are identical (e.g., approximately 499 Kohm each) so that the differential amplifier 708 inverts the input signal and produces an output signal that varies between 2.5 volts and ground. This has the effect of clamping the output signal. For example, if the DUTYCTRL input signal is a DC voltage of 0 volts, then the voltage at the output of the differential amplifier 708 is 2.5 volts, creating a voltage difference from the DUTYCTRL input to the differential amplifier 708 output of 2.5 volts. This 2.5 volts is divided across the resistors 702 and 710 to produce 1.25 volts at the inverting input of the differential amplifier 708, equaling the voltage at the non-inverting input. If the DUTYCTRL input signal is a DC voltage of 2.5 volts, then the voltage at the output of the differential amplifier 708 is 0 volts, creating a voltage difference from the DUTYCTRL input to the differential amplifier 708 output of 2.5 volts. This 2.5 volts is divided across the resistors 702 and 710 to produce 1.25 volts at the inverting input of the differential amplifier 708, equaling the voltage at the non-inverting input. Because the differential amplifier 708 cannot be driven below ground, a DUTYCTRL input signal of greater than 2.5 volts still results in 0 volts at the output.

The voltage at the output of the differential amplifier 708 is provided as an input to the inverting input of the differential amplifier 714. As stated above, the voltage applied to the non-inverting input of the differential amplifier 714 is 1.25 volts. The differential amplifier 714 operates in the same manner as the differential amplifier 708, but the input voltage to the inverting input is limited by the output of the differential amplifier 708 to be in the range of 0–2.5 volts. Therefore, when the DUTYCTRL input is 0 volts, the output of the differential amplifier 708 is 2.5 volts, which results in the output of the differential amplifier being 0 volts. When the DUTYCTRL input is 2.5 volts or higher, the output of the differential amplifier 708 is 0 volts, which results in the output of the differential amplifier being 2.5 volts. Thus, the inverter 16 effectively passes a DC voltage input signal at the DUTYCTRL input to the BRITE input of the PWM circuit 802, but clamps the output voltage at 2.5 volts.

The integrator 16 also coverts a digital pulse train signal into a DC voltage to be used as an input to the PWM circuit 802. If the DUTYCTRL input is a digital pulse train, the differential amplifier 708 inverts and clamps the digital pulse train signal. For example, if a digital pulse train signal having an amplitude of 5 volts with a 75% duty cycle is applied to the DUTYCTRL input, the output of the differential amplifier is a digital pulse train signal having an amplitude of 2.5 volts with a 25% duty cycle. This signal is then input to the differential amplifier 714, which in combination with resistors 712, 720 and capacitors 716, 718 integrates the digital pulse train signal. The output of the differential amplifier 714 is a voltage having an average value substantially proportional to the duty cycle of the DUTYCTRL input signal. For example, for a 75% duty cycle, the output voltage is approximately 1.875 volts (0.75*2.5 volts). As a further example, a DUTYCTRL input signal having a 50% duty cycle would result in an output of the differential amplifier 714 of approximately 1.25 volts. A DUTYCTRL input signal having a 25% duty cycle would result in an output of the differential amplifier 714 of approximately 0.625 volts. Therefore, the integrator 16 creates a DC voltage ($V_{BRITE}$) that is proportional to the duty cycle of the DUTYCTRL input signal.

The second integrator 18 receives a AMPLCTRL input signal and generates the $V_{BRT}$ input signal which controls the amplitude of the output. As discussed below, the AMPLCTRL input signal may be a digital pulse train or an analog signal. The integrator 18 comprises resistors 730, 732, 734, 736, 740, 742, 748, and 955, a capacitor 746, and differential amplifiers 738 and 950, which are advantageously LM324 differential amplifiers. The integrator 18 receives an input signal AMPLCTRL to control the output current amplitude. The input signal AMPLCTRL is applied to a first terminal of the resistor 730. A second terminal of the resistor 730 is connected to the inverting input of the differential amplifier 738 and to a first terminal of the resistor 740. The non-inverting input of the differential amplifier 708 is connected to a first terminal of the resistor 734 and to the first terminal of the resistor 736. A second terminal of the resistor 734 is connected to a first terminal of the resistor 732 and to the non-inverting input of the differential amplifier 950. A second terminal of the resistor 732 is connected to a source voltage $V_{DD}$. The second terminal of the resistor 736 is connected to ground. The output of the differential amplifier 738 is connected to a second terminal of the resistor 740 and to a first terminal of the resistor 742. The second terminal of the resistor 742 is connected to the inverting input of the differential amplifier 950, to a first terminal of the capacitor 746, and to a first terminal of the resistor 748. The output of the differential amplifier 950 is connected to a second terminal of the capacitor 746, to a second terminal of the resistor 748, and to a first terminal of the resistor 955. A second terminal of the resistor 955 is connected to the BRT input of the PWM circuit 802.

The integrator 18 converts a digital pulse train signal or analog waveform from the AMPLCTRL input into a DC voltage in the same manner as the integrator 16. However, the integrator 18 offsets the AMPLCTRL input by a predetermined voltage. The voltage divider provided by the resistors 732, 734, and 736 applies a constant DC voltage to the non-inverting inputs of the differential amplifiers 738 and 950. For example, in the preferred embodiment, the resistor 732 has a resistance approximately six times the resistance of the resistors 734 and 736 (e.g., 18.7 Kohms versus 3.01 Kohms). The voltage applied to the non-inverting input of the differential amplifier 950 is the voltage at a node 733. Because the resistance of the resistor 732 is approximately three times the resistance of the combination of the resistors 734 and 736, the voltage at the node 733 is approximately one-fourth the $V_{DD}$ voltage. Thus, when $V_{DD}$ is approximately 5 volts, the voltage applied to the non-inverting input of the differential amplifier 950 is approximately 1.25 volts. However, the voltage applied to the non-inverting input of the differential amplifier 738 is the voltage at a node 735. Because the resistors 734 and 736 are equal, the voltage at the node 735 is approximately one-half the voltage at the node 733. Thus, when $V_{DD}$ is approximately 5 volts, the voltage applied to the non-inverting input of the differential amplifier 738 is approximately 0.625 volts.

The resistors 730 and 740 configure the differential amplifier 738 as a clamped analog inverter. As with the differential amplifiers 708 and 714 in the integrator 16, the differential amplifiers 738 and 950 are preferably LM324 amplifiers which generate outputs that include ground. This permits clamping of the input signal to zero volts. In particular, in the illustrated embodiment, the resistors 730 and 740 are identical (e.g., approximately 499 Kohm each) so that the differential amplifier 738 inverts and clamps the AMPLCTRL input signal without otherwise changing it's amplitude. For example, if the AMPLCTRL input signal is a DC voltage of 0 volts, then the voltage at the output of the differential amplifier 708 is 1.25 volts, creating a voltage difference from the AMPLCTRL input to the differential amplifier 738 output of 1.25 volts. This 1.25 volts is divided across the resistors 730 and 740 to produce 0.625 volts at the inverting input of the differential amplifier 738, equaling the voltage at the non-inverting input. If the AMPLCTRL input signal is a DC voltage of 1.25 volts, then the voltage at the output of the differential amplifier 738 is 0 volts, creating a voltage difference from the DUTYCTRL input to the differential amplifier 738 output of 1.25 volts. This 1.25 volts is divided across the resistors 730 and 740 to produce 0.625 volts at the inverting input of the differential amplifier 738, equaling the voltage at the non-inverting input. Because the differential amplifier 738 cannot be driven below ground, an AMPLCTRL input signal of greater than 1.25 volts still results in 0 volts at the output.

The voltage in the range of 0–1.25 volts at the output of the differential amplifier 738 is then provided through the resistor 742 as an input to the inverting input of the differential amplifier 950. As stated above, the voltage applied to the non-inverting input of the differential amplifier 950 is 1.25 volts. The differential amplifier 950 operates similarly to the differential amplifier 738, but the input voltage to the inverting input of the differential amplifier 950 is limited by the output of the differential amplifier 738 to be in the range of 0–1.25 volts. If the AMPLCTRL input signal is a DC voltage of 0 volts, then the voltage at the output of the differential amplifier 738 is 1.25 volts. The difference between this 1.25 volts and the output voltage of the differential amplifier 950 is divided across the resistors 742 and 748 to be used as the input signal to the differential amplifier 950. The resistors 742 and 748 are identical (e.g., approximately 499 Kohm each) so that the voltage is evenly divided. Because the voltage at the non-inverting input of the differential amplifier is 1.25 volts, to achieve a matching 1.25 volts at the inverting input of the differential amplifier 950, the voltage at the output of the differential amplifier 950 is 1.25 volts. If the AMPLCTRL input signal is a DC voltage of 1.25 volts, then the voltage at the output of the differential amplifier 738 is 0 volts. The difference between this 0 volts and the output voltage of the differential amplifier 950 is divided across the resistors 742 and 748 to be used as the input signal to the differential amplifier 950. Because the voltage at the non-inverting input of the differential amplifier is 1.25 volts, to achieve a matching 1.25 volts at the inverting input of the differential amplifier 950, the voltage at the output of the differential amplifier 950 is 2.5 volts. Thus, the integrator 18 effectively offsets a DC voltage input signal at the AMPLCTRL input to the BRT input of the PWM circuit 802, but clamps the output voltage at 2.5 volts.

The integrator 18 also coverts a digital pulse train signal into a DC voltage to be used as an input to the PWM circuit 802. If the AMPLCTRL input is a digital pulse train, the differential amplifier 738 inverts and clamps the digital pulse train signal. For example, if a digital pulse train signal having an amplitude of 2.5 volts with a 75% duty cycle is applied to the AMPLCTRL input, the output of the differential amplifier 738 is a digital pulse train signal having an amplitude of 1.25 volts with a 25% duty cycle. This signal is then input to the differential amplifier 950, which in combination with resistors 742, 748 and capacitor 746 integrates the digital pulse train signal and offsets the output by 1.25 volts. In this example, the output of the differential amplifier 950 is a DC voltage of approximately 2.1875 volts, which is greater than the baseline voltage of 1.25 volts by an amount approximately proportional to the AMPLCTRL input signal. As a further example, an AMPLCTRL input signal having a 50% duty cycle results in an output of the differential amplifier 950 of approximately 1.875 volts. An AMPLCTRL input signal having a 25% duty cycle results in an output of the differential amplifier 950 of approximately 1.5625 volts.

The value of the AMPLCTRL input and the DUTYCTRL input is determined by a processor (not shown) or other circuitry based on the dimming level set. The processor or other circuitry may adjust the value of the DUTYCTRL and AMPLCTRL input either independently or in combination to achieve the desired dimming level.

By monitoring the lamp current amplitude and duty cycle, the PWM circuit 802 may control the brightness of the lamps 5. The lamp 5 may be overdriven in low temperatures, and dimmed throughout the temperature range using either duty cycle control, amplitude control, or a combination of the two. This provides a backlight system having the flexibility to operate over a large range of temperatures and brightness levels.

Although described above in connection with CCFLs, it should be understood that a similar apparatus and method can be used to drive fluorescent lamps having filaments, neon lamps, and the like.

Numerous variations and modifications of the invention will become readily apparent to those skilled in the art. Accordingly, the invention may be embodied in other specific forms without departing from its spirit or essential characteristics. The detailed embodiment is to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed is:

1. A method of illuminating a backlight lamp comprising the steps of:

supplying a current signal to the lamp at a first current level;

detecting the temperature of the lamp;

determining whether the temperature exceeds a predetermined level; and reducing the current level of the current signal when the temperature exceeds the predetermined level.

2. The method of claim 1, wherein the first current level is above the normal operating current level.

3. The method of claim 2, wherein the first current level is approximately 12 mA.

4. The method of claim 1, wherein the second current level is within the normal operating current level.

5. The method of claim 4, wherein the second current level is approximately 6 mA.

6. The method of claim 1, wherein the lamp temperature is detected using a resistance temperature device.

7. The method of claim 6, wherein the resistance temperature device is connected to the lamp.

8. The method of claim 6, wherein the resistance temperature device is proximate the lamp.

9. A backlight system comprising:

a lamp;

a current source which provides a drive current to the lamp;

a temperature detector which determines the temperature of the lamp; and a controller which adjusts the amplitude of the current source based on the temperature of the lamp.

10. The backlight system of claim 9, wherein the lamp is a cold cathode fluorescent lamp.

11. The backlight system of claim 9, wherein the temperature detector is a resistance temperature device.

12. The backlight system of claim 9, wherein the controller is a pulse width modulation controller.

13. The backlight system of claim 12, wherein the pulse width modulation controller is an LX1686 regulating pulse width modulator.

14. The backlight system of claim 9, wherein the brightness of the lamp may be controlled by adjusting the amplitude of the drive current.

15. The backlight system of claim 9, wherein the brightness of the lamp may be controlled by adjusting the duty cycle of the drive current.

16. The backlight system of claim 9, wherein the brightness of the lamp may be controlled by adjusting both the amplitude and the duty cycle of the drive current.

17. A method of dimming a backlight lamp comprising the steps of:

receiving a first control signal indicating the desired current duty cycle;

receiving a second control signal indicating the desired current amplitude; and generating an AC current having a defined amplitude and duty cycle.

18. The method of claim 17, wherein the first and second control signals may be either digital or analog.

19. The method of claim 18, wherein the first and second control signals are integrated to create first and second DC voltages.

20. The method of claim 19, wherein the first DC voltage is responsive to the first control signal.

21. The method of claim 19, wherein the second DC voltage is responsive to the second control signal.

22. The method of claim 17, wherein the AC current is generated by a lamp drive network.

23. The method of claim 17, wherein the amplitude and duty cycle of the AC current determines the brightness level of the lamp.

24. A dimmable backlight system comprising:

a lamp;

at least one circuit for converting an input control signal into a DC voltage;

a controller which receives the DC voltage, the controller adjusting either the duty cycle or the amplitude of an output signal based on the DC voltage; and a lamp drive network which converts the output signal into an AC current to illuminate the lamp at a plurality of different brightness levels.

25. The dimmable backlight system of claim 24, wherein the lamp is a cold cathode fluorescent lamp.

26. The dimmable backlight system of claim 24, having a first integrator which provides a duty cycle control signal and a second integrator which provides an amplitude control signal.

27. The dimmable backlight system of claim 24, wherein the brightness level of the lamp is controlled by the duty cycle of the AC current.

28. The dimmable backlight system of claim 24, wherein the brightness level of the lamp is controlled by the amplitude of the AC current.

29. The dimmable backlight system of claim 26, wherein the brightness level of the lamp is controlled by the combination of the duty cycle and the amplitude of the AC current.

30. The dimmable backlight system of claim 24, wherein the controller is a pulse width modulation controller.

31. The dimmable backlight system of claim 24, wherein the pulse width modulation controller is an LX1686 regulating pulse width modulator.

32. An integrator for converting an input signal of either a digital pulse train or an analog waveform into a DC voltage, the integrator comprising:

a first differential amplifier which receives the input signal and clamps the input signal at a predetermined level, the first differential amplifier inverting the input signal to generate an output signal; and a second differential amplifier which receives and integrates the output signal to create a DC voltage.

33. The integrator of claim 32, wherein the first and second differential amplifiers are LM324 amplifiers.

34. The integrator of claim 32, wherein the DC voltage is proportional to the input signal.

35. The integrator of claim 32, wherein the DC voltage is offset from the input signal.

36. A backlight system comprising:

a self-heating cold cathode fluorescent lamp;

a current source which provides a drive current to the lamp;

a temperature detector which determines the temperature of the lamp; and a controller which adjusts the amplitude of the current source based on the temperature of the lamp.

37. The backlight system of claim 36, wherein the temperature detector is mounted on the glass surface of the lamp.

38. The backlight system of claim 36, wherein the controller increases the amplitude of the current source at low temperature.

39. The backlight system of claim 36, wherein the controller receives at least one control signal in either digital or analog form for controlling the brightness of the lamp.

40. The backlight system of claim 36, wherein the controller controls the brightness of the lamp using a combination of amplitude modulation of the drive current and time modulation of periodic bursts of the drive current.

41. A backlight system comprising:

a self-heating cold cathode fluorescent lamp which has a first gas optimized at a first temperature range and a second gas optimized at a second temperature range;

a current source which provides a drive current to the lamp;

a temperature detector which determines the temperature of the lamp; and a controller which adjusts the amplitude of the current source based on the temperature of the lamp.

42. The backlight system of claim 41, wherein the first temperature range is below normal operating temperature, and the second temperature range is normal to high operating temperature.

43. A method of illuminating a self-heating cold cathode fluorescent lamp comprising the steps of:

supplying a current signal to the self-heating cold cathode fluorescent lamp;

detecting the temperature of the self-heating cold cathode fluorescent lamp; and adjusting the amplitude of the current signal based on the temperature of the self-heating cold cathode fluorescent lamp.

44. The method of claim 43, wherein the self-heating cold cathode fluorescent lamp has a first gas optimized at a first temperature range and a second gas optimized at a second temperature range.

45. A method of illuminating a backlight lamp comprising the steps of:

supplying a current signal to the lamp at a first current level;

detecting the temperature of the lamp; and varying the level of the current signal to the lamp based on the temperature of the lamp.

46. A method of illuminating a backlight fluorescent lamp comprising the steps of:

supplying a current signal to the fluorescent lamp at a first current level;

detecting the temperature of the fluorescent lamp; and varying the level of the current signal to the fluorescent lamp based on the temperature of the fluorescent lamp.

47. A method of illuminating a backlight cold cathode fluorescent lamp comprising the steps of:

supplying a current signal to the cold cathode fluorescent lamp at a first current level;

detecting the temperature of the cold cathode fluorescent lamp; and varying the level of the current signal to the cold cathode fluorescent lamp based on the temperature of the cold cathode fluorescent lamp.

48. A backlight system comprising:

a lamp;

a current source which provides a drive current to the lamp at a first current level;

a temperature detector which determines the temperature of the lamp; and a controller which reduces the current level when the temperature exceeds a predetermined level.

49. A backlight system comprising:

a fluorescent lamp;

a current source which provides a drive current to the fluorescent lamp at a first current level;

a temperature detector which determines the temperature of the fluorescent lamp; and a controller which reduces the current level when the temperature exceeds a predetermined level.

50. A backlight system comprising:

a cold cathode fluorescent lamp;

a current source which provides a drive current to the cold cathode fluorescent lamp at a first current level;

a temperature detector which determines the temperature of the cold cathode fluorescent lamp; and a controller which reduces the current level when the temperature exceeds a predetermined level.

51. A method of illuminating a backlight lamp comprising the steps of:

supplying a current signal to the lamp at a first amplitude;

waiting for a predetermined amount of time; and adjusting the current signal to a second amplitude when the predetermined amount of time has elapsed.

52. The method of claim 51, wherein the predetermined amount of time is approximately the amount of time required for the lamp to reach normal operating temperature.

53. The method of claim 51, wherein the first amplitude is greater than the second amplitude.

* * * * *